US007856195B2

(12) United States Patent
Seto

(10) Patent No.: US 7,856,195 B2
(45) Date of Patent: Dec. 21, 2010

(54) IMAGE FORMING APPARATUS WHOSE IMAGE BEARING MEMBER IS ROTATED BY A PULLEY

(75) Inventor: Masaki Seto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 356 days.

(21) Appl. No.: 11/953,376

(22) Filed: Dec. 10, 2007

(65) Prior Publication Data

US 2008/0145101 A1 Jun. 19, 2008

(30) Foreign Application Priority Data

Dec. 14, 2006 (JP) ..... 2006-336967

(51) Int. Cl.
*G03G 15/00* (2006.01)

(52) U.S. Cl. ..... 399/167

(58) Field of Classification Search ..... 399/112, 399/162, 167, 299; 474/109, 111, 133, 134
See application file for complete search history.

(56) References Cited

U.S. PATENT DOCUMENTS 518,314 A * 4/1894 Egger et al. ..... 474/109
5,216,475 A * 6/1993 Ohno ..... 399/75

FOREIGN PATENT DOCUMENTS

| | | | |
|---|---|---|---|
| JP | 62-080648 | A | 4/1987 |
| JP | 6-161205 | A | 6/1994 |
| JP | 2004-183860 | A | 7/2004 |

* cited by examiner

*Primary Examiner*—David M Gray
*Assistant Examiner*—Barnabas T Fekete
(74) *Attorney, Agent, or Firm*—Fitzpatrick, Cella, Harper & Scinto

(57) ABSTRACT

An image forming apparatus for forming an image on a recording material is constituted by an image bearing member, a driving source, a first pulley rotatable by actuation of the driving source, a second pulley, connected to a rotatable member, for transmitting rotation of the driving source to the image bearing member, a belt supported by the first pulley and the second pulley, a first pressing member which is disposed upstream from the first pulley with respect to a rotational direction of the drum and located closer to the second pulley than a rotation axis of the first pulley so as to press the first pulley through the belt, and a second pressing member disposed at a position substantially symmetrically opposite from the first pressing member with respect to a line connecting the rotation axis of the first pulley and a rotation axis of the second pulley so as to press the first pulley through the belt.

13 Claims, 8 Drawing Sheets

IMAGE FORMING APPARATUS WHOSE IMAGE BEARING MEMBER IS ROTATED BY A PULLEY

FIELD OF THE INVENTION AND RELATED ART

The present invention relates to a drive transmission apparatus (belt drive transmission apparatus) suitable for use in precision equipment represented by an image forming apparatus such as a copying machine, a laser beam printer, or a facsimile apparatus.

As a representative example of the precision equipment, a color image forming apparatus will be described. There has been known a color image forming apparatus in which a plurality of image forming stations for forming toner images different in color are arranged along a movement direction of a recording material conveying belt or an intermediary transfer belt. Hereinafter, these belts are collectively referred to as a "transfer belt".

In the image forming apparatus of this type, as a drive transmission apparatus (driving force transmitting apparatus) with respect to a photosensitive drum at each of the image forming stations, a driving motor and a gear speed reducing mechanism as a speed reducing mechanism for rotating a photosensitive drum shaft from a motor shaft are principally used.

Similarly, also as a drive transmission apparatus for a transfer belt, a motor and a gear speed reducing mechanism for transmitting a driving force to a transfer belt driving roller are used. The transfer belt is moved by rotation of the transfer belt driving roller.

Image carrying members (the photosensitive drum and the transfer belt) as rotatable member, which are rotated or moved by the above-described motors and mechanisms, may generally desirably be stably driven at a constant speed in order to ensure image accuracy with high precision. Therefore, an image is transferred onto a recording material while being positioned with high precision, so that a high-quality output image free from color shift, image non-uniformity, and positional deviation is obtained as a resultant product.

The problem with using gears for transmitting a drive force is that they are susceptible to engaging pitch non-uniformity between the gears, which affects the rotation of the photosensitive drum or the transfer belt. As a result, a drive transmission mechanism using a belt may preferably be used for reducing the effect of the pitch non-uniformity on the image.

Japanese Laid-Open Patent Application (JP-A) Hei 06-161205 discloses a constitution in which a plurality of belts is connected while the driving force from a motor shaft as a driving source is divided.

However, in the drive transmission constitution using the belt, in order to prevent slipping between the belt and a pulley, the belt tension is increased in some cases. As a result, with respect to the motor shaft and the photosensitive drum shaft, shaft tilt can be caused to occur by the belt tension. The shaft tilt can change the driving speed to cause the occurrence of image non-uniformity due to a color shift or a partial reduction in image magnification.

In order to prevent the shaft tilt, JP-A 2004-183860 discloses a constitution in which a center distance or parallelism is accurately defined with respect to two supporting frames.

However, even when the strength is increased as in the constitution of JP-A 2004-183860, the load on the shaft by the tension of the belt is not alleviated, so that the presence of the load can lower drive stability of the rotation shaft.

Further, JP-A Sho 62-80648 discloses a constitution in which a plurality of pulleys contacts a pulley for supporting a belt by the medium of the belt. In this constitution, on a shaft of the pulley which supports the belt, a force toward another pulley is exerted by tension of the belt, but this arrangement of the plurality of pulleys cannot sufficiently reduce the load by the belt tension on the drive shaft which supports the belt.

SUMMARY OF THE INVENTION

A principal object of the present invention is to provide an image forming apparatus capable of alleviating a load on a shaft by tension of a belt to enhance rotation stability of a pulley in a drive transmission apparatus using the pulley and the belt.

According to an aspect of the present invention, there is provided an image forming apparatus for forming an image on a recording material, comprising: an image bearing member;

a driving source;

a first pulley rotatable by actuation of the driving source;

a second pulley, connected to a rotatable member, for transmitting rotation of the driving source to the image bearing member;

a belt supported by the first pulley and the second pulley;

a first pressing member which is disposed upstream from the first pulley with respect to a rotational direction of the belt and located closer to the second pulley than a rotation axis of the first pulley so as to press the first pulley through the belt; and a second pressing member disposed at a position substantially symmetrically opposite from the first pressing member with respect to a line connecting the rotation axis of the first pulley and a rotation axis of the second pulley so as to press the first pulley through the belt.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiments of the present invention will be described with reference to the drawings.

Embodiment 1

(1) Image Forming Station

Figure 1:
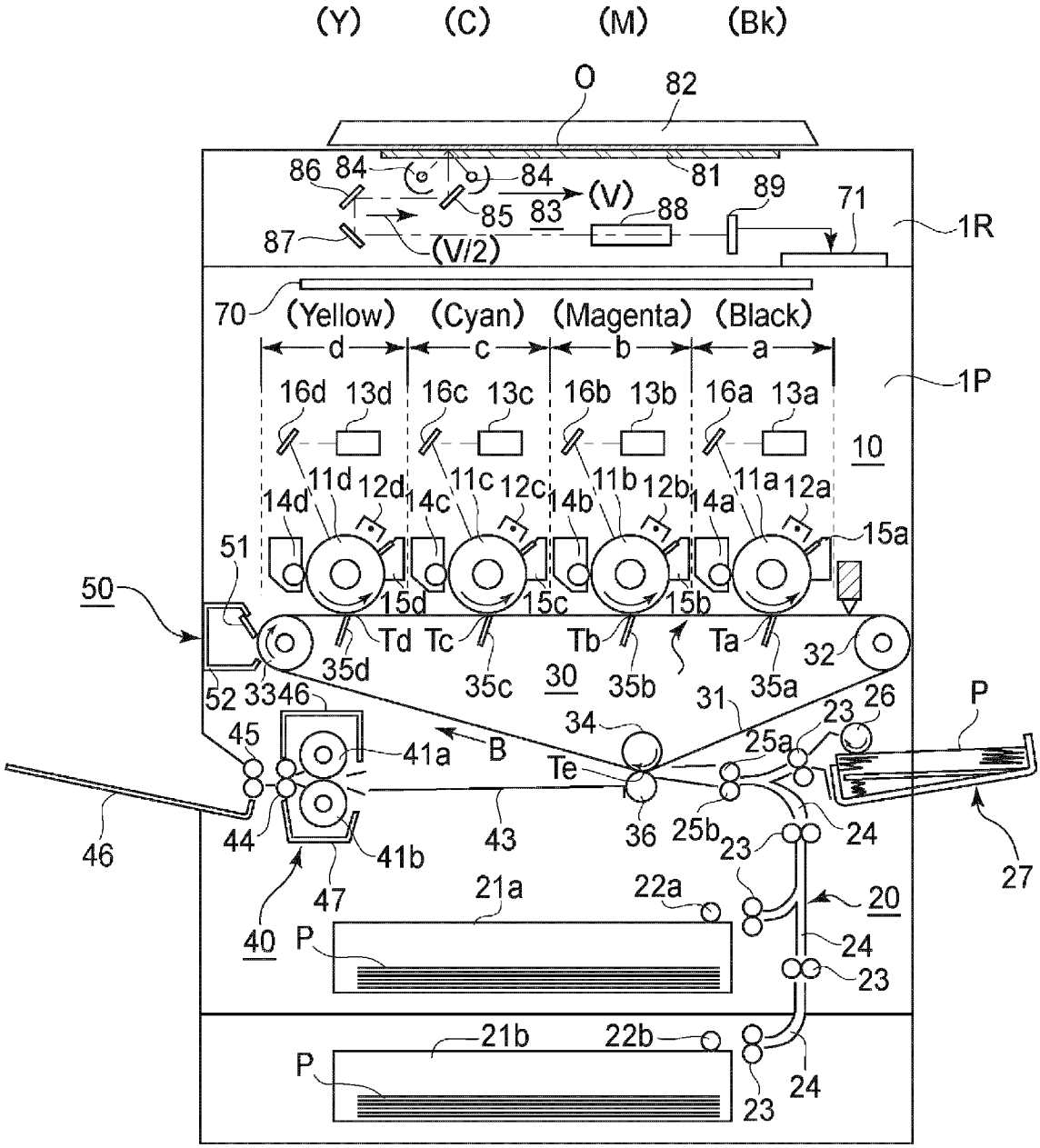
FIG. 1 is a schematic structural view of an image forming apparatus in Embodiment 1.

FIG. 1 is a schematic structural view showing an embodiment of an image forming apparatus using a belt drive transmission apparatus according to the present invention. The image forming apparatus of this embodiment is a four-color based full-color copying machine employing electrophotography, and the apparatus employs a laser beam scanning exposure method, and an intermediary transfer method. The image forming apparatus includes a reader portion 1R and a printer portion 1P, which includes four image forming stations provided in a tandem arrangement.

1) Reader Portion 1R

The reader portion 1R is an image reader for photoelectrically reading image information on an original.

An original O to be copied is placed upside down on an original supporting plate glass 81 in accordance with a predetermined placing reference and is covered with an original cover plate 82. When a copy start key at an operating portion (not shown) is pressed, an image reading mechanism portion 83 is actuated to photoelectrically read a downward image surface of the original O on the glass 81. The image reading mechanism portion 83 is an image reader of an optical system movement type including an original illumination light source 84, reflection mirrors 85-87, an imaging lens system 88, an image reading element 89, such as a CCD array or the like, etc. Electrical information of the original image photoelectrically read by the image reading element 89 is inputted into a control unit 70 through an image processing portion 71 to provide an image-modulated digital image signal.

2) Printer Portion 1P

The printer portion 1P roughly includes an image forming portion 10, a sheet feeding unit 20, an intermediary transfer unit 30, a fixing unit 40, the control unit 70, etc.

The image forming portion 10 includes four image forming stations a, b, c and d having the same constitution. At each of the image forming stations a to d, a drum-type electrophotographic photosensitive member (hereinafter referred to as a "drum") 11*a*, 11*b*, 11*c* or 11*d* as a first image bearing member is supported by a drum shaft and rotationally driven in a counterclockwise direction indicated by an arrow by a belt drive transmission apparatus as a drum driving system described later. Around the drums 11*a* to 11*d*, peripheral members including primary charges 12*a* to 12*d*, optical systems 13*a* to 13*d*, fold-back minors 16*a* to 16*c*, developing devices 14*a* to 14*d*, and drum cleaning apparatuses 15 to 15*d* are disposed opposite to outer peripheral surfaces of the drums 11*a* to 11*d* with respect to a drum rotational direction.

The surfaces of the drums 11*a*-11*d* are electrically charged uniformly by the primary charges 12*a*-12*d* to a predetermined polarity and a predetermined potential. The drum surfaces after the charging are exposed to light by the optical systems 13*a*-13*d* to form thereon electrostatic latent images.

Each of the optical systems 13*a*-13*d* is a laser scanning exposure apparatus in this embodiment and includes a laser light source, a polygonal minor, and the like. Each of the optical systems 13*a*-13*d* outputs laser light (beam) modulated corresponding to a digital image signal inputted from the control unit 70, so that each of the surfaces of the drums 11*a*-11*d* is subjected to scanning exposure with the laser light through one of the associated fold-back minors 16*a*-16*d*.

The electrostatic latent images formed on the drums 11*a*-11*d* are developed into toner images by the developing devices 14*a*-14*d* accommodating toners (developers) of black (Bk), magenta (M), cyan (C), and yellow (Y), respectively. These toner images are transferred onto an endless type intermediary transfer belt 31 as a second image carrying member rotationally driven in a direction indicated by an arrow B at primary transfer areas Ta, Tb, Tc and Tb in the intermediary transfer unit 30. Toner remaining on the drums 11*a*-11*d* without being transferred onto the transfer belt 31 are removed from the drum surfaces by the drum cleaning apparatuses 15*a*-15*d*. As a result, the surfaces of the drums 11*a*-11*d* are cleaned and repeatedly subjected to image formation.

The above described image forming process is carried out at a predetermined control timing at each of the stations a-d, so that formation of the toner images of yellow, cyan, magenta and black is successively performed.

The sheet-feeding unit 20 includes upper and lower (first and second) sheet-feeding cassettes 21*a* and 21*b* and a manual feeding tray 27 in which sheets of a recording material (a sheet like recording material or a recording medium) P are stacked and accommodated. The sheet-feeding unit 20 further includes pick up rollers 21*a*, 21*b* and 26 for feeding the recording material P one by one from the sheet-feeding cassette 21*c* and 21*b* and the mutual feeding tray 26. The unit 20 further includes a sheet-feeding roller pair 23 and a sheet-feeding guide 24 for conveying the recording material P fed from the respective pick up rollers to a registration roller pair 25*a* and 25*b*. The registration roller pair 25*a* and 25*b* are opposing rollers for sending the recording material P to a secondary transfer area Te with predetermined control timing.

The intermediary transfer unit 30 is provided with an endless transfer belt 31 as the intermediary transfer member. The transfer belt 31 is extended around three rollers consisting of a driving roller 33 for transmitting drive (driving force) to the belt, a tension roller 32 for imparting tension to the belt, and a secondary transfer opposing roller 34. Between the driving roller 33 and the tension roller 32, a primary transfer plane A is formed. At the primary transfer areas Ta-Td where the transfer belt 31 contacts the respective drums 11*a*-11*d*, chargers 35*a*-35*d* for primary transfer are disposed on a back surface (inner peripheral surface) of the belt 31 so that they are located opposite to the drums 11*a*-11*d*, respectively, through the belt 31.

The transfer belt 31 is rotationally driven by the driving roller 33 actuated by a belt drive transmission apparatus as a transfer belt driving system described later. The driving roller 33 is prepared by coating a surface of a metal roller with a layer of rubber material (urethane or chloroprene rubber) in a thickness of several mm to prevent slip with respect to the transfer belt 31. The tension roller 32 and the secondary transfer opposing roller 34 are rotated by the rotation of the transfer belt 31.

To the secondary transfer opposing roller 34, a secondary transfer roller 36 is disposed oppositely to form the secondary transfer area Te in a nip between the rollers 34 and 36. The secondary transfer roller 36 is pressed against the transfer belt 31 at an appropriate pressure.

At a contact portion where the transfer belt 31 contacts the driving roller 33, a belt cleaning apparatus 50 for cleaning the surface of the transfer belt 31 is disposed. The belt cleaning apparatus 50 includes a cleaning blade 51 for removing secondary transfer residual toner deposited on an image forming surface of the transfer belt 31 and a waste toner box 52 for containing the removed secondary transfer residual toner as waste toner.

The fixing unit 40 includes a fixing roller portion 46 having a fixing roller 41*a* containing a heat source and a pressing roller portion 47, having a pressing roller 41*b* containing a heat source, brought into contact with the fixing roller 41*a*.

The recording material P which has passed through the secondary transfer area Te is guided by a guide 43 and introduced into a fixing nip. The recording material P coming out of the fixing nip is discharged out of the fixing unit 40 by inner sheet discharging rollers 44 and is further discharged on a sheet discharge tray 48 through outer sheet discharging rollers 45.

The control unit 70 includes a control board for controlling operations of the mechanisms in the above-described respective units and a motor drive board (not shown).

When an image forming operation start signal is sent, the recording material P is fed one by one from, e.g., the first sheet-feeding cassette 21*a* by a pick up roller 22*a*. The fed recording material P is guided in the sheet-feeding guide 24 by the sheet-feeding roller pair 23 to be conveyed to the registration roller pair 25*a* and 25*b*. At that time, rotation of the registration roller pair 25*a* and 25*b* is stopped, so that a leading end of the recording material P reaches a nip between the rollers 25*a* and 25*b*. Thereafter, the rotation of the registration roller pair 25*a* and 25*b* is started. This rotation start timing is set so that the leading end of the recording material P coincides with a leading end of the superposed toner images primary-transferred from the respective stations a-d onto the transfer belt 31, in the secondary transfer area Te.

At each of the stations a-d, when the image forming operation start signal is sent, the above-described image forming process is sequentially started. First, a yellow toner image formed on the drum 11*d* at the most upstream-side station d with respect to the rotational direction of the transfer belt 31 is primary-transferred onto the transfer belt 31 in the primary transfer area Td by the charger 35*d* for primary transfer to which a high voltage is applied. The yellow toner image primary-transferred onto the transfer belt 31 is conveyed to a subsequent (adjacent) primary transfer area Tc. At each of the stations a-d, the image forming process is performed with a delay of the time required for conveying the toner image between adjacent two stations, so that a current toner image is transferred and superposed on a preceding toner image in registration. This operation is repeated until the final toner image is primary-transferred, so that four-color toner images consisting of the yellow toner image, cyan toner image, magenta toner image, and black toner image are finally primary-transferred onto the transfer belt 31 in a superposition manner.

Thereafter, when the recording material P enters the secondary transfer area Te by the rotation of the transfer belt 31 and contacts the transfer belt 31, a high voltage is applied to the secondary transfer roller 36 in synchronism with passing timing of the recording material P. As a result, the superposed four color toner images on the transfer belt 31 are simultaneously secondary-transferred onto the surface of the recording material P.

Thereafter, the recording material P is accurately guided into the fixing nip between the fixing roller 431*a* and the pressing roller 41*b*. In the fixing nip, the recording material P is heated and pressed by these rollers 41*a* and 41*b*, so that the toner image is fixed on the surface of the recording material P. Thereafter, the recording material P is discharged on the sheet discharge tray 48 by the inner and outer sheet discharging rollers 44 and 45.

(2) Drum Driving System and Transfer Belt Driving System

Figure 2:
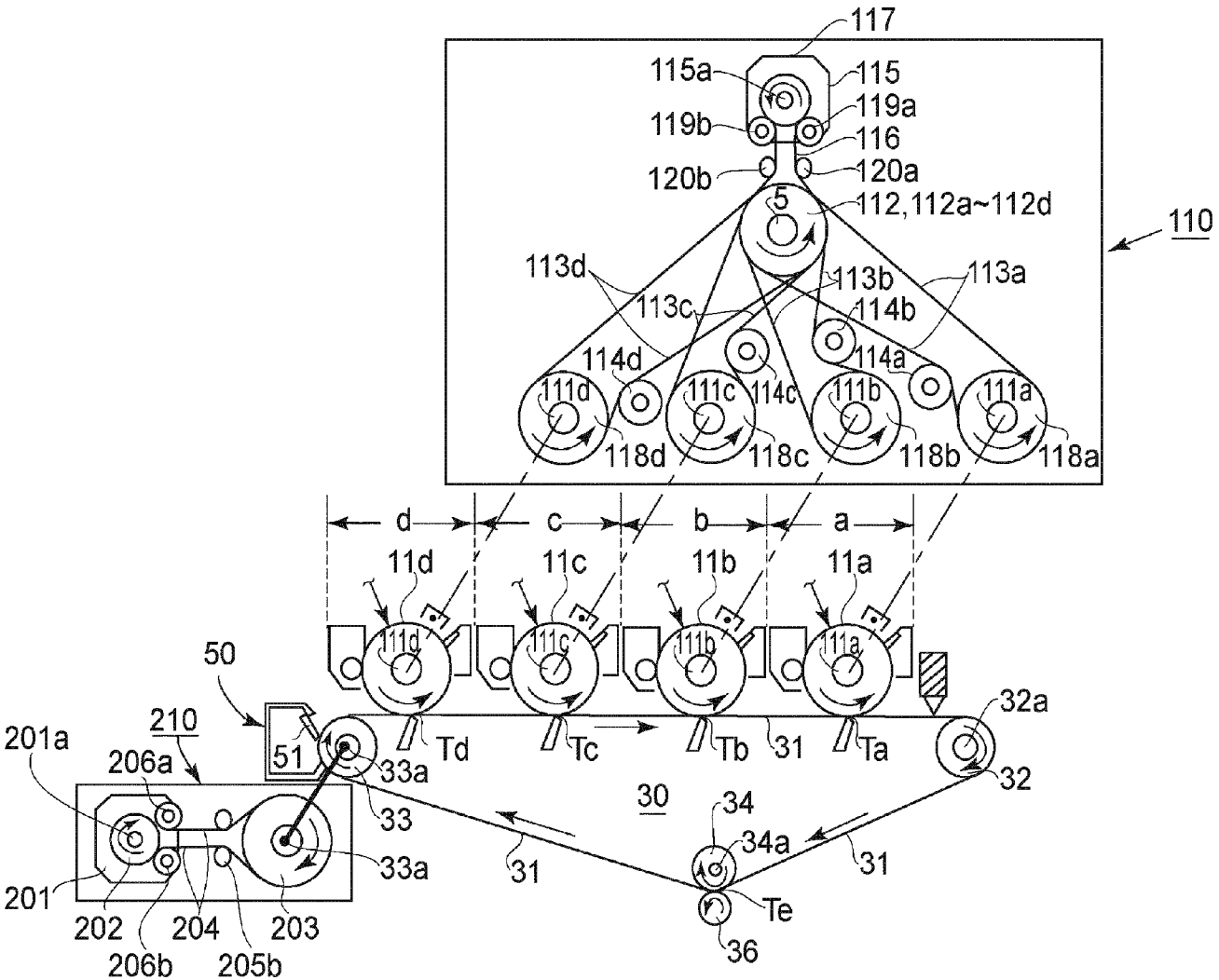
FIGS. 2 and 3 are schematic views each for illustrating a drum driving system and a transfer belt driving system.
Figure 3:
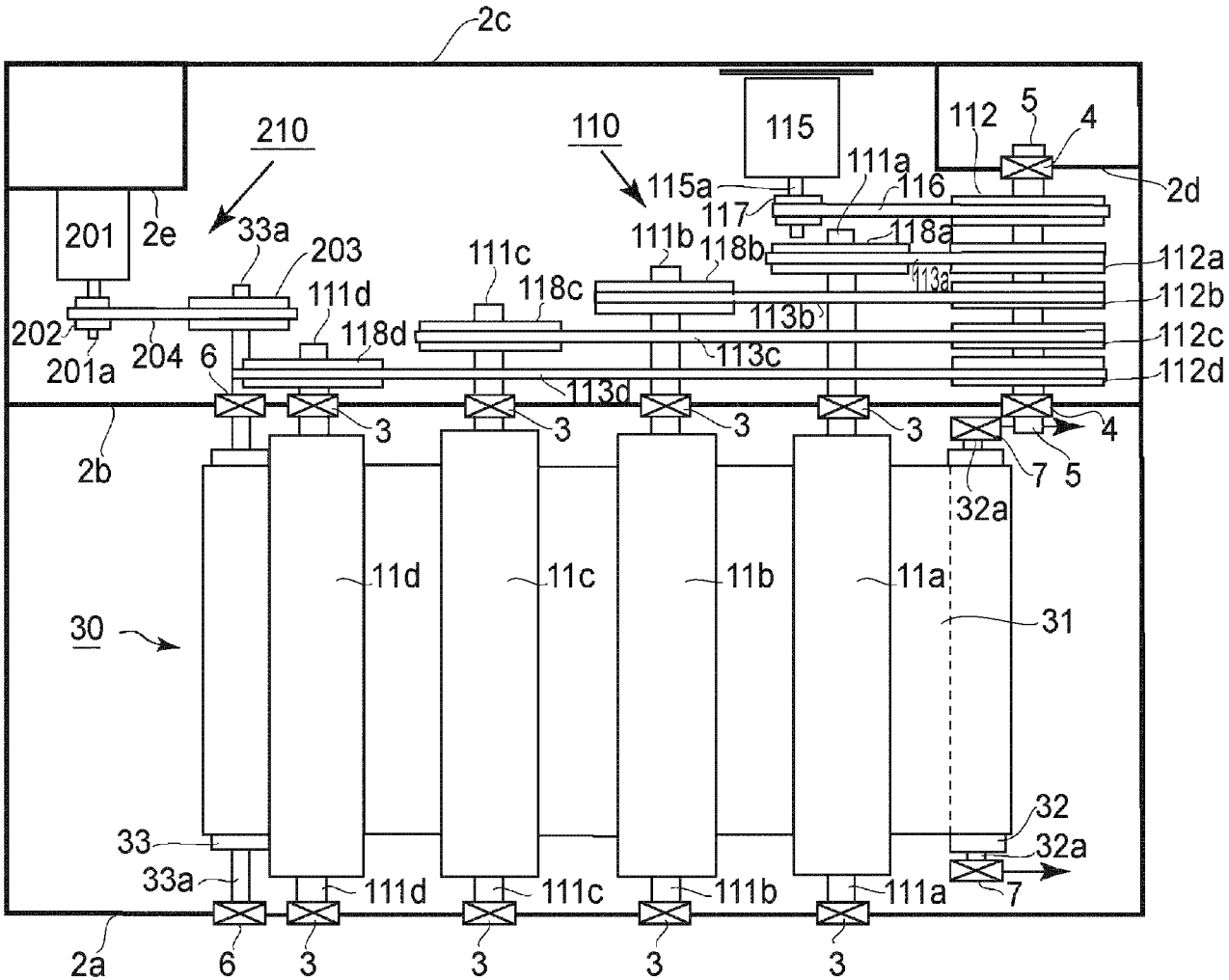

Arrangements and structures of a belt for transmitting a drive force from a driving source to the drum and a belt for transmitting a drive force from a driving source to the transfer belt will now be discussed. FIGS. 2 and 3 are schematic views showing a driving system 110 for the drums 11*a*-11*d* at the image forming portion 10 and a driving system 210 for the transfer belt 31 at the intermediary transfer unit 30.

(2-1) Drum Driving System 110

First, the drum driving system 110 will be described. The drums 11*a*-11*d* are arranged in parallel between first and second opposing side plates 2*a* and 2*b* of a casing (frame or chassis) of the image forming apparatus while being rotatably held at both ends of drum shafts 111*a*-111*d* through bearing members 3. To these drum shafts 111*a*-111*d*, a rotational force of a motor shaft 115*a* of a drum driving motor (driving source) is transmitted by the belt drive transmission apparatus as the drum driving system 110, so that the drums 11*a*-11*d* are driven in a predetermined identical direction at a predetermined identical speed. The motor 115 is stationarily fixed and disposed on a third side plate 2*c* located opposite to the second side plate 2*b*. To this motor shaft 115*a* of the motor 115, a driving motor pulley (driving pulley) 117 is concentrically integrally fixed and disposed. Further, between the second side plate 2*b* and a fourth side plate 2*d* located opposite thereto, an idler pulley shaft 5 as a rotatable member is rotatably held at both ends thereof through bearing members 4. To this idler pulley shaft 5, first to fifth (five) idler pulleys (follower pulleys) 112 and 112*a*-112*d* are concentrically integrally provided. Further, at the second side plate 2*b* side, at end portions of the drum shafts 111*a*-111*d*, drum pulleys 118*a*-118*d* are fixedly disposed. The center of the rotatable member (rotation axis) substantially coincides with the center of the idler pulleys.

Between the driving pulley 117 and the first idler pulley 112, a drive transmission belt 116 which is a metal-made flat belt is stretched. Further, tensioner rollers 120*a* and 120*b* for applying tension to the belt 116 and back-up pulleys (pressing members) 119*a* and 119*b* for preventing shaft tilting, of the motor shaft 115*a* as the driving shaft, caused by the tension of the belt 116 are disposed. These tensioner rollers 120*a* and 120*b* and the back-up pulleys 119 and 119*b* are specifically described later. A center line of the driving shaft substantially coincides with a shaft axis of the driving pulley. Further, the shaft axis of the driving pulley coincides with a rotation axis of the driving pulley.

Between the second idler pulley 112*a* and the driving pulley 118*a*, a belt 113*a* which is a metal-made flat belt is stretched. To the belt 113*a*, tension is applied by a tensioner roller 114*a*. Between the third idler pulley 112*b* and the driving pulley 118*b*, a belt 113*b* which is a metal-made flat belt is stretched. To the belt 113*b*, tension is applied by a tensioner roller 114*b*. Between the fourth idler pulley 112*c* and the driving pulley 118*c*, a belt 113*c* which is a metal-made flat belt is stretched. To the belt 113*c*, tension is applied by a tensioner roller 114*c*. Between the fifth idler pulley 112*d* and the driving pulley 118*d*, a belt 113*d* which is a metal-made flat belt is stretched. To the belt 113*d*, tension is applied by a tensioner roller 114*d*.

With respect to the driving pulley 117, the first idler pulley 112 is a large diameter pulley. In this embodiment, the first to fifth idler pulleys 112 and 112*a*-112*d* and the drum pulleys 118*a*-118*d* are identical diameter pulleys. The axes of the motor shaft 115*a*, the idler pulley shaft 5, and the drum shafts 111*a*-111*d* are parallel to each other.

A rotational force of the motor shaft 115*a* of the motor 115 is transmitted to the first idler pulley 112 through the driving pulley 117 and the belt 116 to rotationally drive the idler pulley shaft 5. The diameter of the first idler pulley 112 is larger than that of the driving pulley 117, so that a rotational speed of the motor shaft 115*a* is reduced and transmitted to the idler pulley shaft 5. By the rotation of the idler pulley shaft 5, the second to fifth idler pulleys 112*a*-112*d* concentrically integral with the shaft 5 are also rotated. Then, rotation of the second idler pulley 112*a* is transmitted to the drum shaft 111*a* through the belt 113*a* and the drum pulley 118*a* thereby the rotationally drive the drum 11*a*. Further, rotation of the third idler pulley 112*b* is transmitted to the drum shaft 111*b* through the belt 113*b* and the drum pulley 118*b* thereby the rotationally drive the drum 11*b*. Further, rotation of the fourth idler pulley 112*c* is transmitted to the drum shaft 111*c* through the belt 113*c* and the drum pulley 118*c* thereby the rotationally drive the drum 11*c*. Further, rotation of the fifth idler pulley 112*d* is transmitted to the drum shaft 111*d* through the belt 113*d* and the drum pulley 118*d* thereby the rotationally drive the drum 11*d*.

(2-2) Transfer Belt Driving System 210

In the intermediary transfer unit 30, the driving roller 33 for rotationally driving the transfer belt 31 is rotatably held and disposed between the first and second side plates 2*a* and 2*b* of the apparatus casing at both end portions of the roller shaft 33*a* through bearing members 6. Similarly, the secondary transfer opposing roller 34 is rotatably held between the first and second side plates 2*a* and 2*b* of the apparatus casing at both end portions of the roller shaft 34*a* through bearing members and is disposed in parallel to the driving roller 34. The tension roller 32 is rotatably held by bearing members 7 movably supporting both end portions of a roller shaft 32*a* and moves and urges the bearing members 7 in a direction in which tension is applied to the transfer belt 31. The axes of the driving roller 33, the secondary transfer opposing roller 34, and the tension roller 32 are parallel to the axes of the drum shafts 111*a*-111*d*.

A rotational force of a motor shaft 201*a* of a transfer belt driving motor (driving source) 201 is transmitted to the roller shaft 33*a* of the driving roller 33 by a belt drive transmission apparatus as the transfer belt driving system 210, so that the transfer belt 31 is driven in a predetermined rotational direction at a predetermined rotational speed.

The motor 201 is stationarily fixed and provided to a fifth side plate 2*e* located opposite to the second side plate 2*b*. To the motor shaft 201*a* of the motor 201, a driving pulley 202 is concentrically integrally fixed and provided. Further, at an end portion, close to the second side plate 2*b*, of the roller shaft 33*a* of the driving roller 33, a transfer belt pulley 203 is fixedly disposed.

Between the driving pulley 202 and the transfer belt pulley 203, a drive transmission belt 204 which is a metal-made flat belt is stretched. Further, tensioner rollers 205*a* and 205*b* for applying tension to the belt 204 and back-up pulleys (pressing members) 206*a* and 206*b* for preventing shaft tilting of the motor shaft 201*a* caused by the tension of the belt 204 and disposed. These tensioner rollers 205*a* and 205*b* and the back-up pulleys 206*a* and 206*b* are specifically described later.

The axes of the motor shaft 201*a* and the roller shaft 33*a* of the driving roller 33 are parallel to each other. With respect to the driving pulley 202, the transfer belt pulley 203 is large diameter pulley.

A rotational force of the motor shaft 201*a* of the motor 201 is transmitted to the transfer belt pulley 203 through the driving pulley 202 and the belt 204 to rotationally drive the roller shaft 33*a* of the driving roller 33. The diameter of the transfer belt pulley 203 is larger than that of the driving pulley 202, so that the rotational speed of the motor shaft 201*a* is reduced and transmitted to the roller shaft 33*a* thereby, to rotationally drive the driving roller 33. As a result, the transfer belt 31 is driven in a predetermined rotational direction at a predetermined rotational speed.

(2-3) Alleviation of Shaft Tilting of Motor Shaft

In the driving system 110 of the drum 11 as the rotatable member, a rotational speed of the motor shaft 115*a* of the drum driving motor (driving source) 115 is transmitted through the driving pulley 117 (first pulley), the first idler pulley 112 (second pulley) which has a larger diameter than that of the driving pulley 117, and the belt 116 stretched between the pulleys 117 and 112.

Generally, the rotational speed of the drums 11*a*-11*d* is slower than the rated speed of a general-purpose DC motor or pulse motor as the drum driving motor 115. On the drum shafts 111*a*-111*d*, a large drive load torque is exerted by a contact load of the cleaning members 15*a*-15*b* against the drums and adsorption of the transfer belt with respect to the drums by high voltage application at the transfer portions Ta-Td. For this reason, driving force transmission from the motor 115 to the drums 11*a*-11*d* requires ensuring of a torque margin by a speed reducing mechanism.

Figure 4:
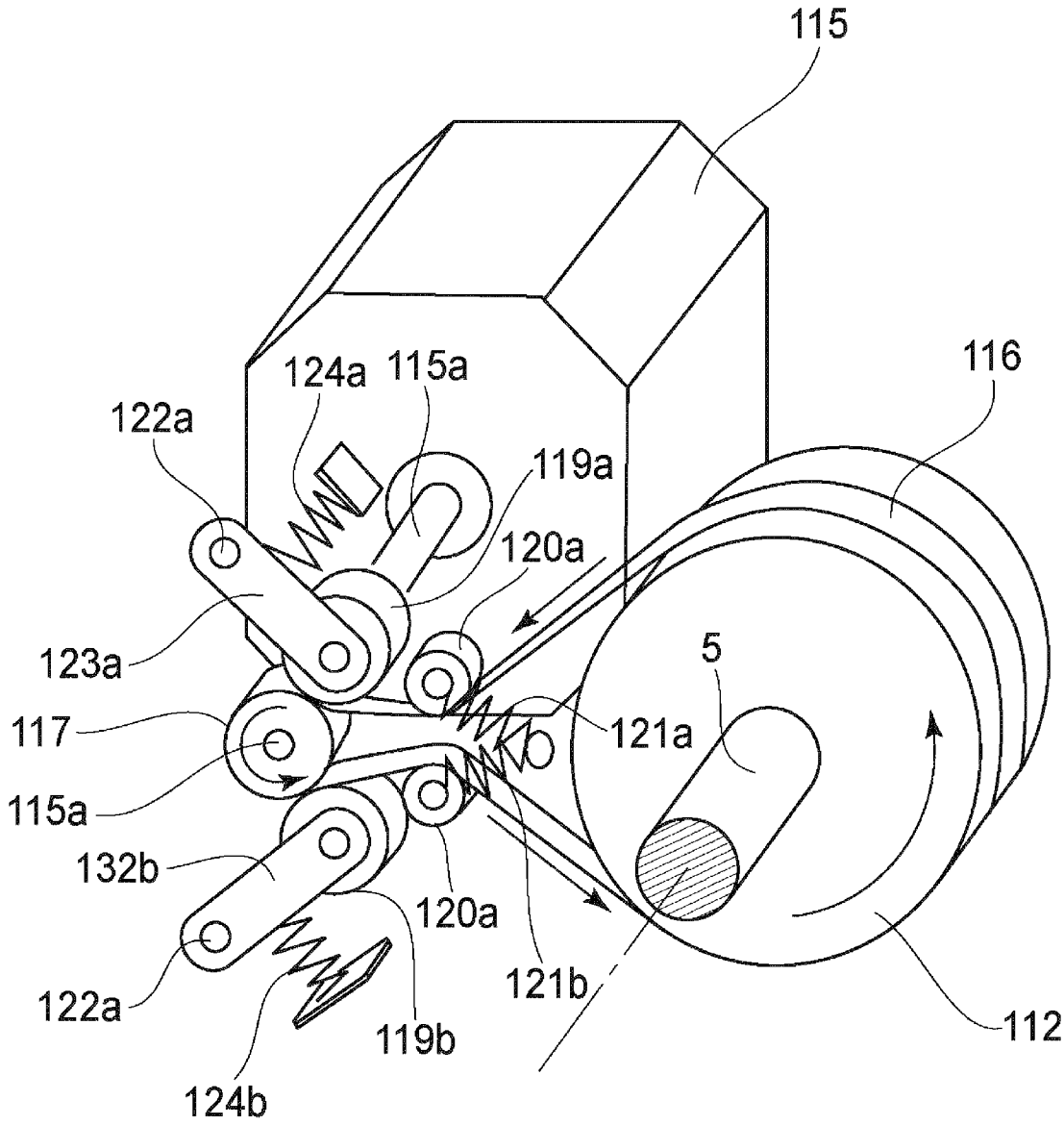
FIG. 4 is a schematic perspective view of a speed reducing mechanism portion of the drum driving system.
Figure 5:
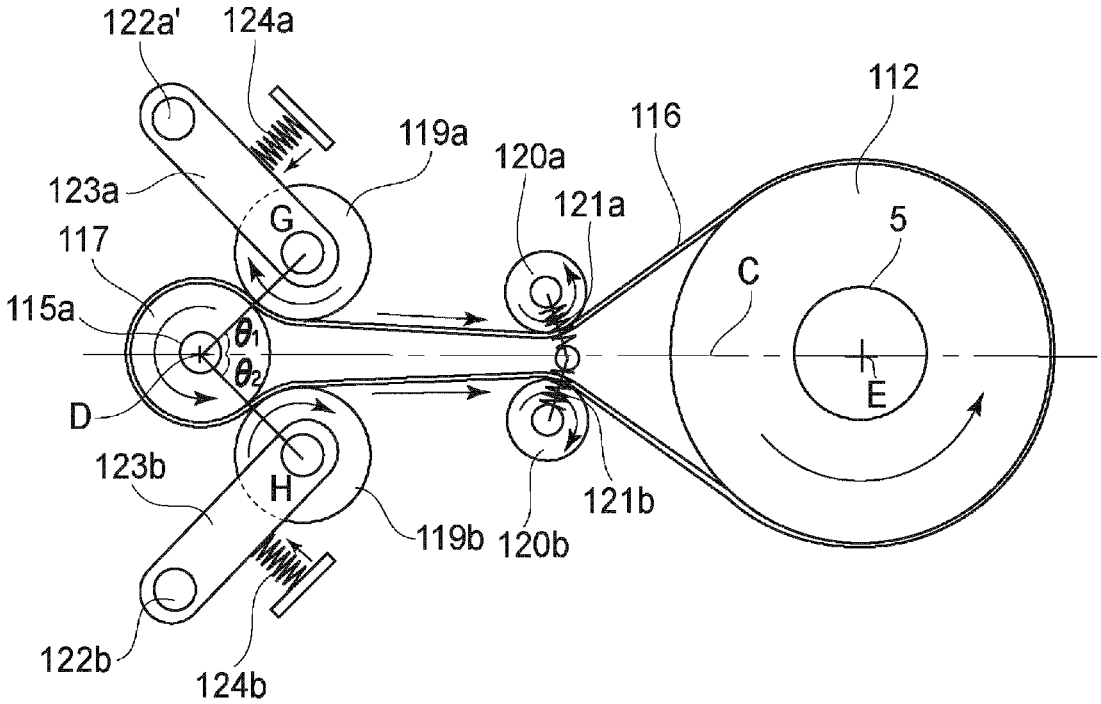
FIG. 5 is a schematic front view of the speed reducing mechanism portion of the drum driving system.

FIG. 4 is a schematic perspective view of the above-described speed reducing mechanism portion in the drum driving system 110 and FIG. 5 is schematic front view of the speed reducing mechanism portion.

In FIG. 5, a reference symbol C represents a line connecting a center (rotation axis) D of the driving pulley 117 as a drive-side pulley and a center (rotation axis) E of the first idler pulley 112 as a follower-side pulley. The tensioner rollers 120*a* and 120*b* for applying tension to the belt 116 stretched between the driving pulley 117 and the idler pulley 112 are disposed at substantially symmetrical positions with respect to the axis C. These tensioner rollers 120*a* and 120*b* are pressed against the outer surface of the belt 116 by tension springs 121*a* and 121*b*, respectively, to the tension to the belt 116. The belt tension applied by the tensioner rollers 120*a* and 120*b* can be calculated from an arrangement and pressing forces of the tensioner rollers 120*a* and 120*b*.

In this embodiment, the metal-mode flat belt is used as the drive transmission belt 116. Compared with a toothed belt, a metal-made flat or V belt free from engaging tooth is used and a high tension is applied to the belt, so that pitch non-uniformity caused by the engaging tooth does not occur with the result that a high drive transmission torque can be ensured.

In this embodiment, the metal-made flat belt is used as the belt 116, so that a high tension is required. Particularly, in the speed reducing mechanism, a pulley radius of the driving pulley 117 as the drive-side pulley is constituted so as to be smaller than that of the idler pulley 112 as the follower-side pulley, so that the motor shaft 115*a* of the motor 115 has a relatively small diameter. For this reason, with respect to the high tension for preventing belt slip, the motor shaft 115*a* having low rigidity can cause shaft tilting by the action of the high tension. Therefore, the problem of the shaft tilting is solved by providing the back-up pulleys (pressing members) 119*a* and 119*b* for alleviating the shaft tilting of the motor shaft 115*a*.

The back-up pulleys 119*a* and 119*b* are disposed at substantially symmetrical positions with respect to the above-described axis C and are pressed against the driving pulley 117 through the belt 116 interposed therebetween. The symmetrical positions mean positions providing substantially equal angles θ1 and θ2 when the angle θ1 is formed between the line C and a line connecting the center (rotation axis) D of the driving pulley 117 and a center (rotation axis) G of the back-up pulley 119*a* and the angle θ2 is formed between the line C and a line connecting the center D of the driving pulley 117 and a center (rotation axis) H of the back-up pulley 119*b*. These back-up pulleys 119*a* and 119*b* are disposed at an upstream side and a downstream side, respectively, with respect to the rotational direction of the belt 116 extended around the driving pulley 117. Further, in this embodiment, the back-up pulleys 119*a* and 119*b* are disposed so as to not only increase the winding amount of the belt 116 around the driving pulley 117 but also be pressed substantially from the idler pulley 112 side toward the shaft axis of the driving pulley 117. The pressing portions of the back-up pulleys against the driving pulley are located closer to the idler pulley than the rotation center (rotation axis) of the driving pulley. As a result, force of the back-up pulleys with respect to the driving pulley are exerted on the shaft 115*a* in a direction opposite to a shaft tilting direction, so that the shaft tilting can be alleviated. The back-up pulleys 119*a* and 119*b* are rotatably supported by rotatably swingable arms 123*a* and 123*b*, respectively, with shaft portions 122*a* and 122*b* as centers of the rotation. Further, the swingable arms 123*a* and 123*b* are rotationally urged toward the driving pulley 117 by pressing springs 124*a* and 124*b*, respectively, to press the back-up pulleys 119*a* and 119*b* against the driving pulley 117 through the belt 116.

Figure 6:
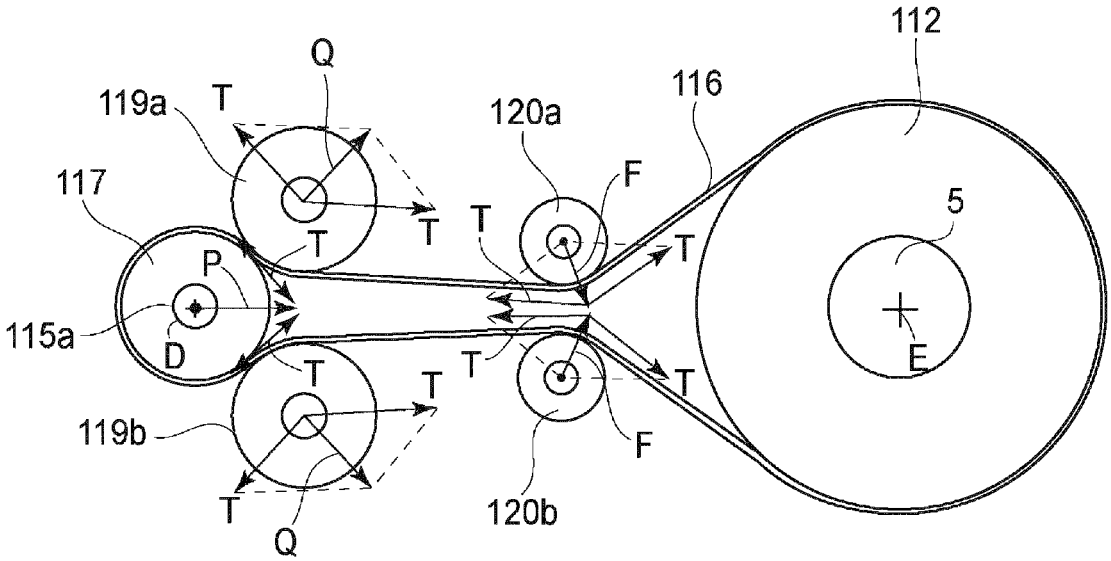
FIGS. 6 to 8 are schematic views each for illustrating a relationship between a belt tension and a back-up force.
Figure 7:
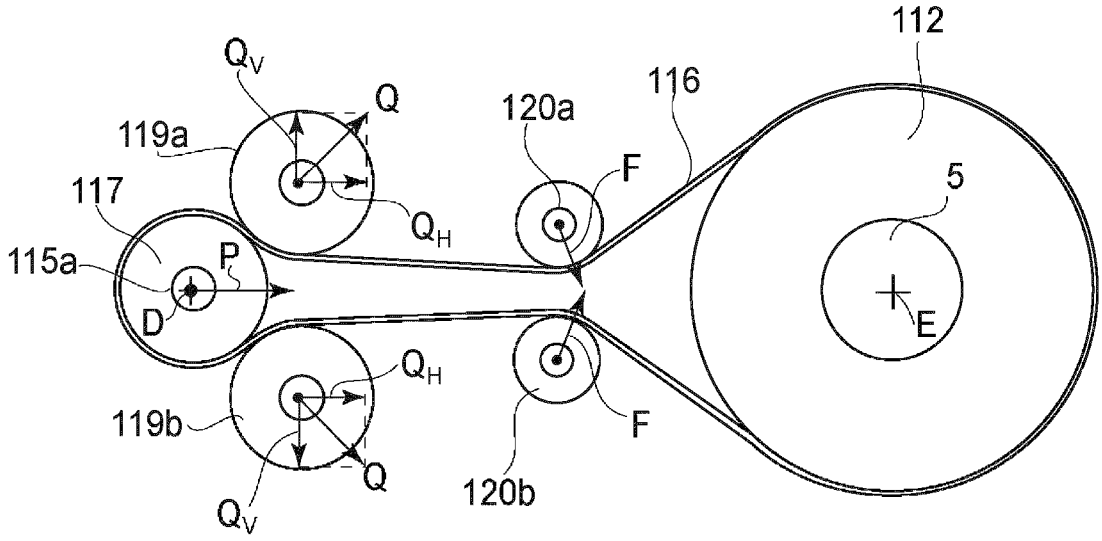
Figure 8:
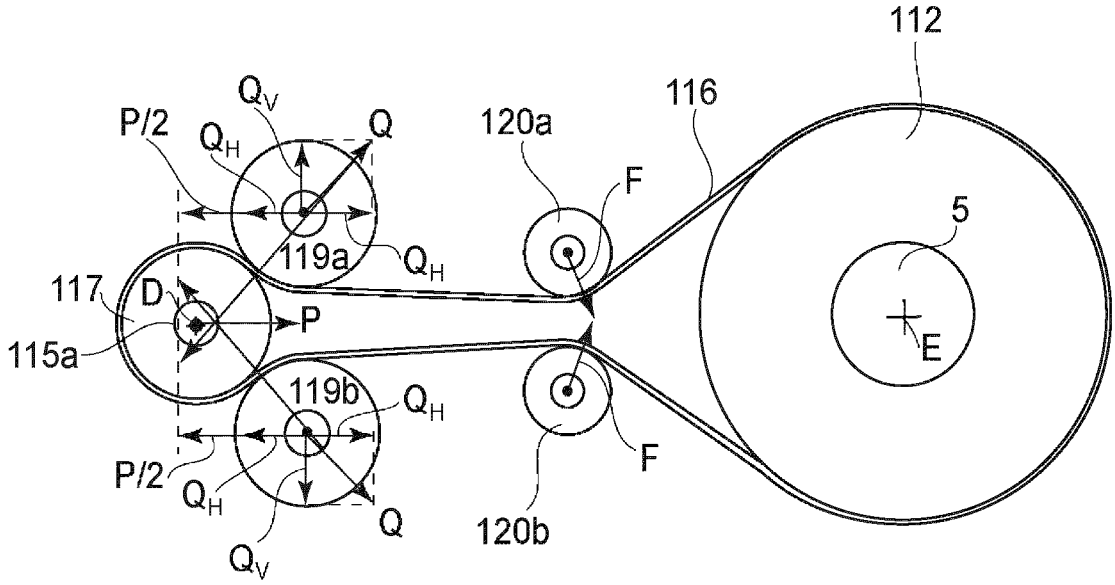

Further, in this embodiment, the back-up pulleys 119*a* and 119*b*, as shown in FIGS. 6 to 8, apply back-up forces from outside of the belt 116 to the driving pulley 117 so that the resultant of forces is zero in a force relationship with the belt tension.

Specifically, this can be easily designed by obtaining forces acting on the driving pulley 117 to determine the back-up forces of the back-up pulleys 119*a* and 119*b* in the following manner.

As shown in FIG. 6, when pressing forces exerted on the belt 116 by the tensioner rollers 120*a* and 120*b* are taken as F, belt tensions T are obtained as components of forces of belt winding angles. The belt tensions T provide the driving pulley 117 and the back-up pulleys 119*a* and 119*b* with resultant forces P and Q, respectively.

In this case, as shown in FIG. 7, when each of the resultant forces P and Q applied to the driving pulley 117 and the back-up pulleys 119 and 119*b* are divided into forces in a horizontal direction and a vertical direction, a force P in the horizontal direction is applied to the driving pulley 117. Further, the resultant force Q of each of the back-up pulleys 119*a* and 119*b* is divided into a horizontal component force $Q_H$ and a vertical component force Qv.

Here, the sum of the vertical component forces of the back-up pulleys 119*a* and 119*b* and the driving pulley 117 is zero since the back-up pulleys 119*a* and 119*b* are disposed opposite to each other and a phase of the winding angle is an opposite phase with respect to the axis C described above. Further, with respect to the horizontal component forces, the horizontal component force P applied to the driving pulley 117 and the horizontal component force $Q_H$ applied to each of the back-up pulleys 119*a* and 119*b*. These biased horizontal component forces $P+2Q_H$ constitute a force causing the shaft tilting of the motor shaft.

Accordingly, as shown in FIG. 8, a back-up force corresponding to resultant force Q' including a horizontal component force $P/2+Q_H$ with respect to each of the back-up pulleys 119*a* and 119*b* is applied to the driving pulley 117 so as to cancel the biased horizontal component forces. As a result, it is possible to cancel the force $P+2Q_H$ causing the above-described shaft tilting.

In this case, the back-up forces Q' and Q', applied to the driving pulley 117, of the back-up pulleys 119*a* and 119*b* are substantially stretched toward the center (rotation axis) of the motor shaft 115*a*. However, as described above, the problem of the shaft tilting can be solved when the biased horizontal component forces $P+2Q_H$ can be cancelled. For this reason, the back-up forces Q' and Q' of the back-up pulleys 119*a* and 119*b* are not necessarily applied toward the center of the motor shaft 115*a* as the shaft axis of the driving pulley 117.

With respect to the arrangement of the back-up pulleys 119*a* and 119*b*, these back-up pulleys are required to be disposed at substantially symmetrical positions with respect to the axis C, so that it is necessary to dispose the back-up pulleys within ±5 degrees of deviation from their positions with respect to the motor shaft.

Accordingly, the back-up pulleys 119*a* and 119*b* may only be required to satisfy arrangement and contact force relationships so as to provide such a force relationship that the sum of contact forces between the back-up pulleys and the shaft to be protected from the shaft tilting can cancel the sum of the vertical component forces and the sum of the horizontal component forces.

The back-up pulleys 119*a* and 119*b* are brought into contact the driving pulley 117 via the belt 116 so as to increase an amount of winding of the belt 116 around the driving pulley 117. At the same time, the back-up forces Q' and Q' are applied to the driving pulley 117 so as to cancel the force applied toward the direction of the shaft tilting of the motor shaft 115*a* caused by the belt tension. This shaft tilting alleviating constitution can improve not only the stability of the rotation of the belt, but also the shaft tilting alleviating effect by increasing the amount of belt winding.

In the above-described constitution, the force for cancelling the force toward the shaft tilting direction is applied from the back-up pulleys or the like, but in the present invention, a comparable force is not always have to be applied. Even a force which is not the comparable force can achieve the shaft tilting alleviating effect.

In this embodiment, the back-up pulleys are disposed so as to increase the belt winding amount. However, even at positions at which the back-up pulleys cannot increase the belt winding amount, it is possible to achieve the shaft tilting alleviating effect by disposing the back-up pulleys at positions so that their pressing portions are located closer to the idler pulley than the rotational center (rotation axis) of the driving pulley.

Figure 9:
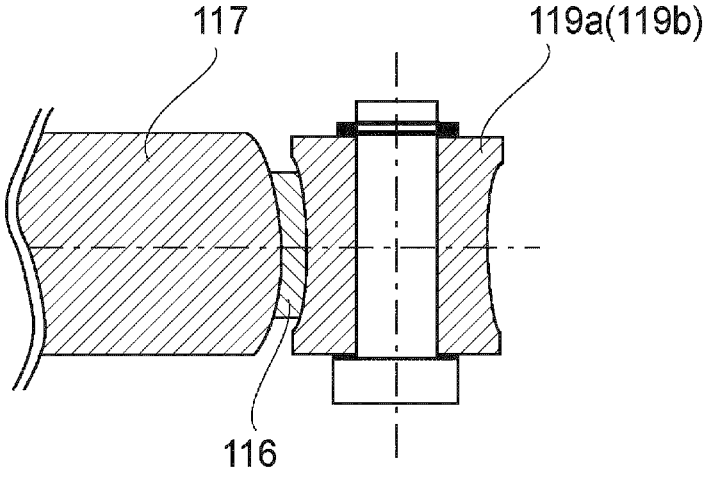
FIG. 9 is a partially enlarged sectional view of a driving pulley and a back-up pulley which contact each other through a belt.

In this embodiment, cross-sectional configurations of the driving pulley 117 and the back-up pulleys 119*a* and 119*b* at the belt winding portion are a positive crowning (convex) configuration and a negative crowning (concave) configuration, respectively, as shown in FIG. 9, so that lateral deviation of the belt is regulated with respect to a thrust direction by pitching the flat belt 116 between the driving pulley and the back-up pulleys. It is also possible to employ the negative crowning configuration for the driving pulley and the positive crowning configuration for the back-up pulleys.

When the thrust regulation of the belt is performed by an ordinary pulley rib, the rib can be broken during continuous use by rubbing with respect to the metal-made belt 116 set to have the high tension. In the present invention, it is possible to provide a lateral deviation preventing function without employing a complicated lateral deviation preventing mechanism.

Figure 10:
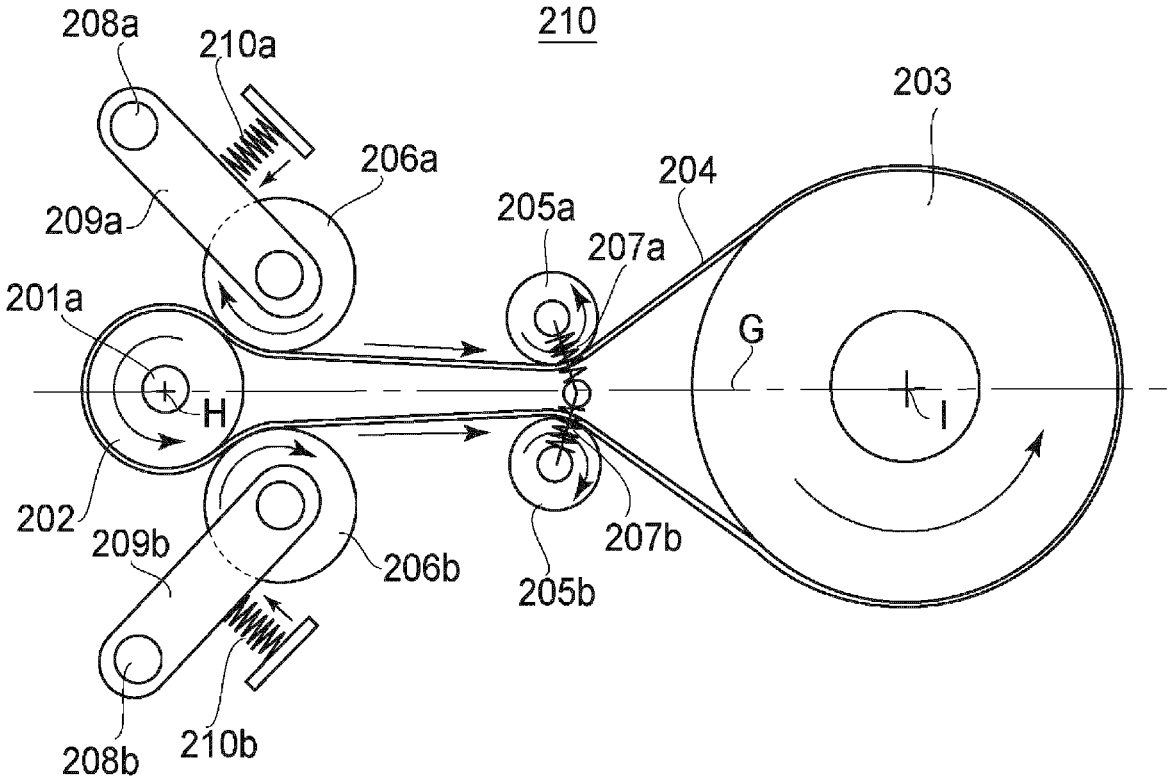
FIG. 10 is a schematic front view of a speed reducing mechanism portion of a transfer belt driving system.

FIG. 10 is a schematic front view of a speed reducing mechanism portion of the driving system 210 for the transfer belt 31 as the rotatable member. Also in this driving system 210, the rotational speed of the motor shaft 201*a* of the transfer belt driving motor (driving source) 201 is reduced by using a driving pulley (first pulley) 202, transfer belt pulley (second pulley) 203 having a larger diameter than the driving pulley 202, and a metal-mode flat belt 204 stretched between these pulleys 202 and 203 as a speed reducing mechanism. Further, in the same constitution as that of the speed reducing mechanism portion of the above-described drum driving system, tensioner rollers 205*a* and 205*b* and back-up pulleys (pressing members) 206*a* and 206*b* are disposed, so that tension is applied to the belt 204 and the shaft tilting of a motor shaft 201*a* is alleviated.

In FIG. 10, a reference symbol G represents a line connecting a shaft axis H of the driving pulley 202 as a drive-side pulley and a shaft axis I of the transfer belt pulley 203 as a follower-side pulley. The tensioner rollers 205*a* and 205*b* for applying tension to the belt 264 stretched between the driving pulley 202 and the transfer belt pulley 203 are disposed at substantially symmetrical positions with respect to the axis G. These tensioner rollers 205*a* and 205*b* are pressed against the outer surface of the belt 204 by tension springs 207*a* and 207*b*, respectively, to the tension to the belt 204.

Also in the transfer belt driving system, the problem of the shaft tilting is solved by providing the back-up pulleys 206*a* and 206*b* for alleviating the shaft tilting of the motor shaft 201*a*.

The back-up pulleys 206*a* and 206*b* are disposed at substantially symmetrical positions with respect to the above-described axis G and are pressed against the driving pulley 202 through the belt 204 interposed therebetween. In this case, the back-up pulleys 206*a* and 206*b* are disposed so as to not only increase the winding amount of the belt 204 around the driving pulley 202, but also be pressed substantially from the transfer belt pulley 203 side toward the shaft axis of the driving pulley 202.

The back-up pulleys 206*a* and 206*b* are rotatably supported by rotatably swingable arms 209*a* and 209*b*, respectively, with shaft portions 208*a* and 208*b* as centers of the rotation. Further, the swingable arms 209*a* and 209*b* are rotationally urged toward the driving pulley 202 by pressing springs 210*a* and 210*b*, respectively, to press the back-up pulleys 206*a* and 206*b* against the driving pulley 202 through the belt 204.

Further, in this embodiment, the back-up pulleys 206*a* and 206*b* apply back-up forces from outside of the belt 204 to the driving pulley 202 so that the resultant of forces is zero in a force relationship with the belt tension. With respect to the back-up forces and the like, they are similar to those in the case of the speed reducing mechanism (FIGS. 4 to 9) for the above-described drum driving system 110, so that the description thereof will be omitted.

According to the constitution of this embodiment, it is possible to not only prevent the shaft tilting but also increase an angle (amount) of winding of the belt around the pulley, so that a shaft tilting force between the belt and the pulley can be increased. The belt is made of metal, so that belt shrinkage is less and thus it is possible to perform stable shaft tilting. As a result, it is possible to provide a relatively inexpensive belt drive transmission apparatus ensuring a high drive transmission torque. Further, in the image forming apparatus representing the precision equipment, by using the belt drive transmission apparatus as a process driving apparatus for the photosensitive drum and the transfer belt, a high-quality output image free from color misregistration and image non-uniformity can be obtained.

Embodiment 2

In this embodiment, in a mechanism in the drum driving system 110 in Embodiment 1, the back-up pulleys 119*a* and 119*b* are constituted to function also as the tensioner rollers.

Figure 11:
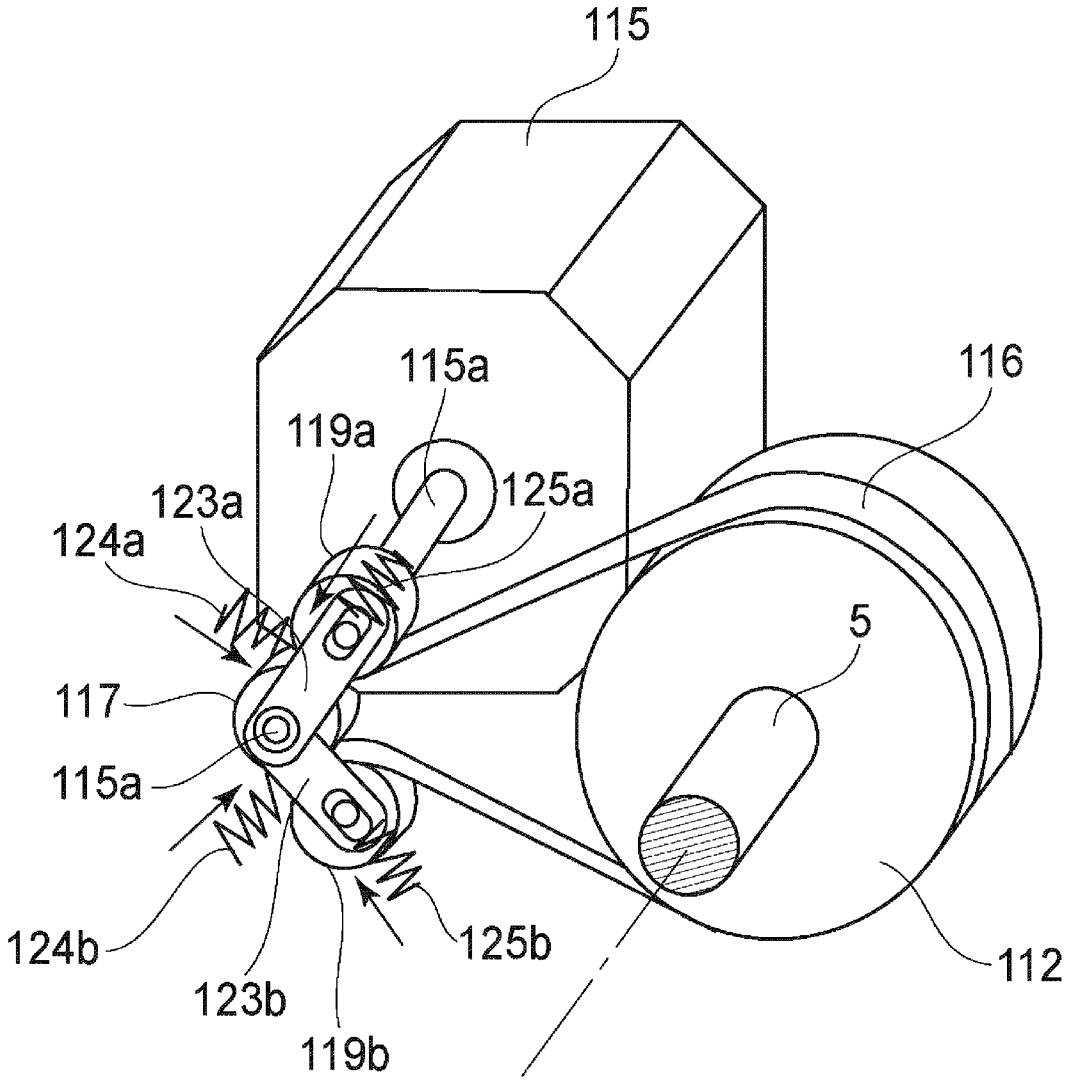
FIG. 11 is a schematic perspective view of a speed reducing mechanism portion of a drum driving system in Embodiment 2.

More specifically, as shown in FIG. 11, the back-up pulleys 119*a* and 119*b* are rotatably with respect to the swingable arms 123*a* and 123*b* rotatable around the motor shaft 115*a* and are slidably movable along an elongated hole (slit) formed in each of the arms with respect to a longitudinal direction of the arm. Further, the swingable arms 123*a* and 123*b* are rotationally urged against the driving pulley 117 by back-up springs 124*a* and 124*b*, respectively, so that the back-up pulleys 119*a* and 119*b* are pressed against the driving pulley 117 via the belt 116. The back-up pulleys 119*a* and 119*b* are pressed against the outer surface of the belt 116 to apply tension to the belt 116.

By this constitution, it is possible to set the back-up forces and the belt tension at the same time so as to be applied by the back-up pulleys 119*a* and 119*b* from outside of portions at which the belt 116 is wound around the driving pulley 117. For this reason, it is possible to simultaneously set the belt tension and the contact force causing no shaft tilting with respect to the motor shaft 115*a*, so that it is possible to ensure a high belt tension and a winding amount with respect to the driving pulley without separately providing a tensioner constitution.

The speed reducing mechanism constitution of the drum driving system 110 in this embodiment is also applicable to the transfer belt driving system 210 in Embodiment 1.

Other Embodiment (1) In Embodiments 1 and 2, it was possible to prevent the shaft tilting and increase the belt winding amount by providing the back-up pulleys 119*a* and 119*b* (206*a* and 206*b*) with respect to the drive-side pulley 117 (202). It is also possible to expect a similar effect even in a constitution such that the back-up pulleys 119*a* and 119*b* (206*a* and 206*b*) are provided with respect to the follower-side pulley 112 (203) to prevent the shaft tilting and increase the belt winding amount. In this case, the back-up pulleys 119*a* and 119*b* (206*a* and 206*b*) are pressed from the drive-side pulley toward the follower-side pulley shaft axis (axial line). Further, it is also possible to expect the similar effect even in a constitution such that the back-up pulleys 119*a* and 119*b* (206*a* and 206*b*) are provided with respect to both of the drive-side pulley 117 (202) and the follower-side pulley 112 (203) to prevent the shaft tilting and increase the belt winding amount. Further, in the above described Embodiments, the back-up members are provided with respect to the drive-side pulley, but the shaft tilting alleviating effect can also be achieved by providing the back-up members with respect to the follower-side pulley.

(2) In Embodiments 1 and 2, it was possible to obtain a large effect by using the metal-made flat belts as the drive transmission belts 116, 113*a*-113*d*, and 204 and by employing the above-described back-up constitution. However, it is also possible to achieve a substantially similar effect even when a toothed belt, a V-belt, an elastic rubber belt, or the like is used as the drive transmission belt.

(3) In the above-described embodiments, the rotatable member is the rotation shaft for rotating another pulley, but the rotatable member can be the rotation shaft of the photosensitive member as the rotatable member. Similarly, the rotatable member can be a shaft of the driving roller for driving the intermediary transfer member.

(4) In Embodiments 1 and 2, the usefulness of the present invention is described with respect to the belt drive transmission apparatus in the color image forming apparatus which is a representative apparatus as the precision equipment. However, the belt drive transmission apparatus in the present invention can also achieve a similar effect even when the belt drive transmission apparatus is used in apparatuses, other than the color image forming apparatus, such as other precision machines, electrical appliances, and mechanical apparatuses.

As described hereinabove, according to the present invention, it is possible to improve rotation stability of the pulley by enhancing contact between the belt and the pulley while alleviating a load, exerted on the shaft of the pulley, caused by tension of the belt.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 336967/2006 filed Dec. 14, 2006, which is hereby incorporated by reference.

What is claimed is:

1. An image forming apparatus for forming an image on a recording material, comprising:

an image bearing member;

a driving source;

a first pulley rotatable by driving power of said driving source;

a second pulley, for transmitting driving power of said driving source to said image bearing member;

a belt supported by said first pulley and said second pulley;

a first pressing pulley which is disposed upstream from said first pulley with respect to a rotational direction of said belt so as to press said first pulley through said belt, wherein a rotation axis of said first pressing pulley is provided between a rotation axis of said first pulley and a rotation axis of said second pulley with respect to a direction of a line connecting the rotation axis of said first pulley and the rotation axis of said second pulley;

a second pressing pulley disposed at a position substantially symmetrically opposite from said first pressing pulley with respect to the line connecting the rotation axis of said first pulley and the rotation axis of said second pulley so as to press said first pulley through said belt;

a first spring for pressing a first supporting member, for supporting said first pressing pulley, against said belt member so that said first pressing pulley presses said first pulley through said belt; and a second spring for pressing a second supporting member, for supporting said second pressing pulley, against said belt member so that said second pressing pulley presses said first pulley through said belt, wherein said first pressing pulley and said second pressing pulley press said first pulley through said belt at the same time so that a pressing force toward said first pulley by said first pressing pulley and a pressing force toward said first pulley by said second pressing pulley are canceled out with each other with respect to a direction perpendicular to the line connecting the rotation axis of said first pulley and the rotation axis of said second pulley.

2. An apparatus according to claim 1, wherein said first and second pressing pulleys increase a contact area between said first pulley and said belt.

3. An apparatus according to claim 1, wherein the rotation axis of said second pulley substantially coincides with a rotation axis of a rotatable member connected to said second pulley.

4. An apparatus according to claim 1, wherein said first and second pressing pulleys have a negative crowning configuration as a peripheral surface configuration.

5. An apparatus according to claim 1, wherein said first and second pressing pulleys are swingable with respect to a peripheral surface of said first pulley.

6. An apparatus according to claim 1, wherein said second pulley has an outer diameter larger than that of said first pulley.

7. An apparatus according to claim 1, wherein an angle formed between a line connecting rotation axes of said first pressing pulley and said first pulley and the line connecting rotation axes of said first and second pulleys is substantially equal to an angle formed between a line connecting rotation axes of said second pressing pulley and said first pulley and the line connecting rotation axes of said first and second pulleys.

8. An apparatus according to claim 1, wherein said image forming apparatus further comprises a first tension pulley and a second tension pulley which are disposed upstream and downstream, respectively, from said second pulley with respect to the rotational direction of said belt, each of said first and second tension pulleys being rotatable and configured and positioned to press said belt.

9. An apparatus according to claim 1 wherein each of said first and second pressing pulleys is provided with an elastic member for pressing said first or second pressing pulley against said first pulley.

10. An apparatus according to claim 1, wherein said image bearing member is a photosensitive drum.

11. An apparatus according to claim 1, wherein said image bearing member is an intermediary transfer member for carrying a toner image.

12. An apparatus according to claim 1, wherein said first pressing pulley and said second pressing pulley press said first pulley through belt at the same time so that a pressing force toward said first pulley by said first pressing pulley and a pressing force toward said first pulley by said second pressing member pulley cancel out a tension of said belt with respect to a direction in which a rotation axis of said first pulley and a rotation axis of said second pulley are connected.

13. An apparatus according to claim 6, further comprising a first tension pulley and a second tension pulley which are disposed upstream and downstream, respectively, from said second pulley with respect to the rotational direction of said belt, each of said first and second tension pulleys being rotatable and configured and positioned separately from said second pulley so that neither said first tension pulley nor said second tension pulley press said second pulley through said belt.

* * * * *